United States Patent [19]

Atkins

[11] 4,232,692

[45] Nov. 11, 1980

[54] CANOPY FRAME

[76] Inventor: Philip A. Atkins, Rte. 2, Box 801, Chico, Calif. 95926

[21] Appl. No.: 972,401

[22] Filed: Dec. 22, 1978

[51] Int. Cl.[3] ..... A47C 29/00

[52] U.S. Cl. ..... 135/5.1; 5/113; 5/414; 5/418; 135/7.1 R

[58] Field of Search ..... 135/5.1, 5 R–5 E, 135/7.1; 5/113, 414, 416, 418

[56] References Cited

U.S. PATENT DOCUMENTS

| | | | |
|---|---|---|---|
| 368,206 | 8/1887 | Hardy | 135/7.1 R |
| 385,633 | 7/1888 | Kelly et al. | 5/414 X |
| 508,072 | 11/1893 | Willingham | 135/5.1 |
| 560,245 | 5/1896 | Wagner | 135/5.1 |
| 1,039,993 | 10/1912 | Murphy | 5/416 |
| 1,732,716 | 10/1929 | Ealy | 5/414 X |
| 2,301,511 | 11/1942 | Boyce | 135/5.1 |
| 2,357,056 | 8/1944 | Nelson | 135/5.1 |
| 2,737,193 | 3/1956 | Boyd | 135/5.1 |
| 3,860,980 | 1/1975 | Ebert | 5/416 |

FOREIGN PATENT DOCUMENTS

| | | | |
|---|---|---|---|
| 576157 | 5/1924 | France | 135/5.1 |
| 426174 | 10/1947 | Italy | 5/418 |

*Primary Examiner*—J. Karl Bell

*Attorney, Agent, or Firm*—Blair, Brown & Kreten

[57] ABSTRACT

Disclosed herein is a framework which forms a support for mosquito netting or the like. The framework includes an inverted U-shaped end piece having two upwardly turning support ribs originating from the ends of the end piece. The framework is able to be interconnected and means are disclosed for the easy fabrication and disassembly thereof.

5 Claims, 9 Drawing Figures

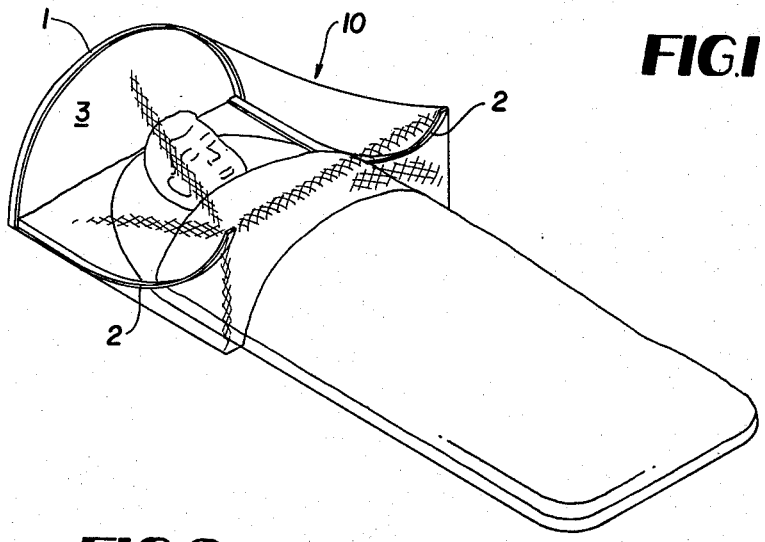
FIG.1
FIG.2
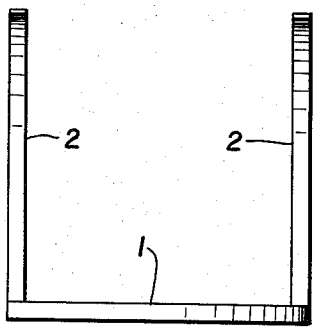
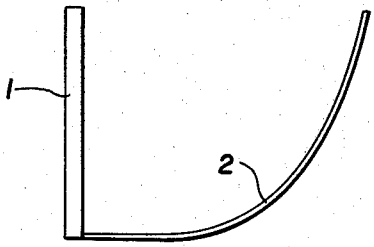
FIG.3
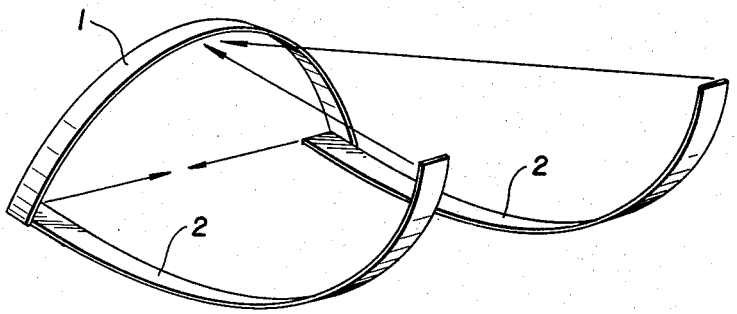
FIG.4
FIG.5
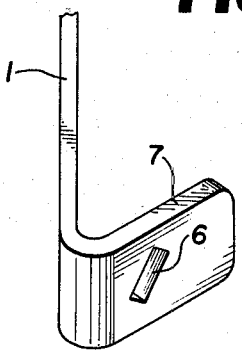

CANOPY FRAME

BACKGROUND OF THE INVENTION

Prior art devices which have been deemed closest to the following specification include the following U.S. Pat. Nos.

508,072, Willingham,
560,245, Wagner,
1,845,814, Reis et al,
2,301,511, Boyce,
2,737,193, Boyd, None of these patents appear to have the versatility of the instant invention and certainly do not disclose the specific structure. In addition however these other units are limited in the fact that they can not be as easily disassembled and readily stored and transported.

SUMMARY OF THE INVENTION

The present invention obviates the deficiencies noted over the prior art by providing an apparatus in which an objective is to emphasize portability.

A further object is to support a spacious canopy using minimal frame material to effect light weight.

A further object contemplates providing ease of use and disassembly while still being durable.

Other objects and advantages will become apparent in the following specification when considered in light of the attached drawings.

BRIEF DESCRIPTION OF THE DRAWINGS.

FIG. 1 is a perspective view of the frame according to the present invention;

FIG. 2 is a top plan view thereof with the netting removed;

FIG. 3 is a side view thereof;

FIG. 4 is a perspective view indicating lines of the frame and showing forces on the spring frame;

FIG. 5 shows a connecting element;

DESCRIPTION OF THE PREFERRED EMBODIMENTS

Figure 6:
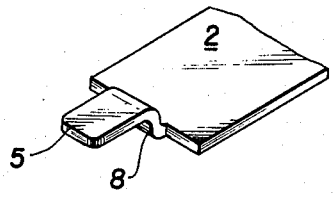
FIG. 6 shows the connecting element to be used with the element of FIG. 5.

Referring to the drawings now wherein like reference characters refer to like parts throughout the several drawings reference numeral 10 is generally directed to the canopy frame of the present invention.

The frame 10 can generally be regarded as a U-shaped hoop member 1 disposed in an inverted position having two opposed legs curving upward to form support bars 2.

Figure 7:
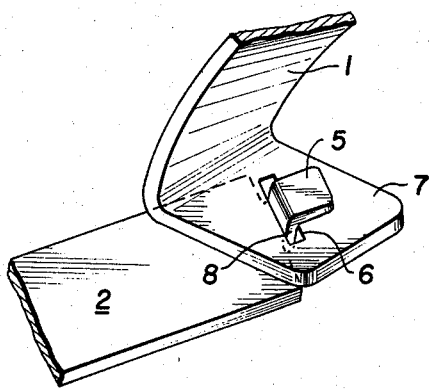
FIG. 7 shows the two connecting elements interconnected.

Convenient assembly and disassembly of the frame can be had by using the following method and structure of interconnecting separate 1 and 2 members. FIGS. 5, 6 and 7 show these best. They may generally be regarded as follows: U-shaped member 1 terminates in an inwardly extending flanged protuberance 7 having an elongated slot 6 disposed thereon. Element 2 terminates in a tab 5 horizontally offset from frame element 2 by means of shoulder 8. Element 2 at shoulder 8 should be wider than slot 6 to prevent passage of 2 through the slot. FIG. 7 shows engagement while fabrics 3 are in use. Joints, hinges or the like may be positioned along members 1 and 2 for ease of frame use.

Figure 8:
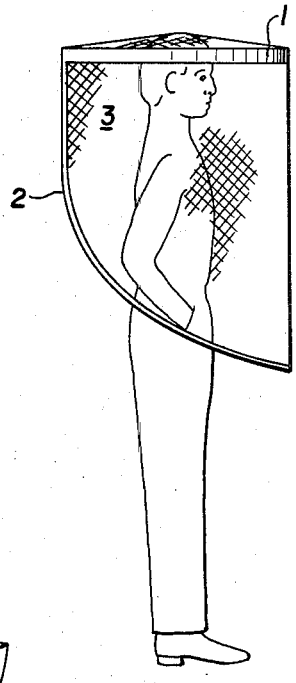
FIG. 8 shows an additional use of the object of the present invention.
Figure 9:
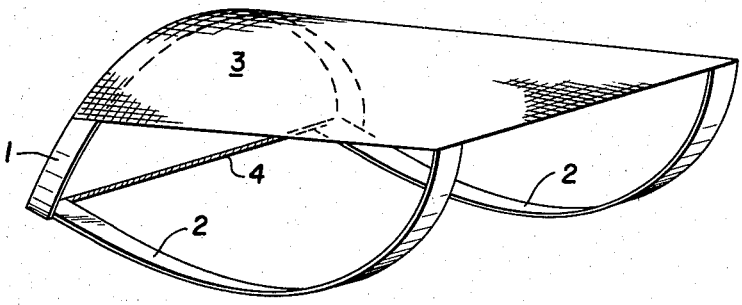
FIG. 9 shows an additional structural member that is optional.

FIG. 4 shows convenient lines of force to be exerted on frame elements when they are sprung. FIG. 9 shows a cord 4 used to spring element 1 while fabric 3 is used to spring elements 2. The synergistic forces of FIG. 4 are best illustrated by FIGS. 1 and 8 since fabric 3 alone springs the frame.

Having thus described the invention it will be apparent that numerous structural modifications and adaptations may be resorted to without departing from the spirit of the invention.

What is claimed is:

1. A canopy frame for supporting a netting or the like comprising in combination:

a substantially "U" shaped frame member in which terminal portions of legs of said "U" shaped frame member are spaced apart and said "U" shaped element lies totally in one plane, a pair of spaced parallel elements having substantially flat portions connected orthogonally to said terminal portions of said "U" shaped frame, thereby adapted to serve as a support base, said spaced parallel coextensive elements each terminating in an arcuate portion, curved so as to extend in a same direction as said U shaped member, whereby end areas of said arcuate portions never are interbraced and each end area is equidistant from an axis of symmetry of said U shaped frame member.

2. The device of claim 1 onto which fabric is disposed.

3. The device of claim 1 in which said U shaped frame member is provided with inwardly extending protuberances disposed on said terminal portions of said legs, slots extending through said protuberances, and said flat portions of said spaced parallel coextensive elements are fastened through said slots by means of a tab extending from said flat portion through said slot.

4. The device of claim 3 wherein said tab is horizontally offset from said flat portion by means of an interconnecting, upstanding shoulder having a width less than the wideth of said flat portion.

5. The device of claim 4 wherein said tab has the same width as said shoulder.

* * * * *